US005934105A

United States Patent [19]

Bonaquist et al.

[11] Patent Number: 5,934,105

[45] Date of Patent: Aug. 10, 1999

[54] CRYOGENIC AIR SEPARATION SYSTEM FOR DUAL PRESSURE FEED

[75] Inventors: Dante Patrick Bonaquist; Michael James Lockett, both of Grand Island, N.Y.

[73] Assignee: Praxair Technology, Inc., Danbury, Conn.

[21] Appl. No.: 09/034,397

[22] Filed: Mar. 4, 1998

[51] Int. Cl.[6] ..... F25J 3/02

[52] U.S. Cl. ..... 62/646; 62/940

[58] Field of Search ..... 62/646, 940

[56] References Cited

U.S. PATENT DOCUMENTS

| | | | |
|---|---|---|---|
| 4,464,188 | 8/1984 | Agrawal et al. | 62/13 |
| 4,543,115 | 9/1985 | Agrawal et al. | 62/25 |
| 4,704,148 | 11/1987 | Kleinberg | 62/24 |
| 5,233,838 | 8/1993 | Howard | 62/25 |
| 5,263,328 | 11/1993 | Rohde | 62/25 |
| 5,275,003 | 1/1994 | Agrawal et al. | 62/24 |
| 5,309,721 | 5/1994 | Rathbone | 62/39 |
| 5,379,599 | 1/1995 | Mostello | 62/646 |
| 5,386,692 | 2/1995 | Laforce | 62/646 |
| 5,467,601 | 11/1995 | Paolino et al. | 62/38 |
| 5,467,602 | 11/1995 | Paolino et al. | 62/646 |
| 5,469,710 | 11/1995 | Howard et al. | 62/646 |
| 5,600,970 | 2/1997 | Drnevich et al. | 62/651 |

*Primary Examiner*—Ronald Capossela
*Attorney, Agent, or Firm*—Stanley Ktorides

[57] ABSTRACT

A dual feed pressure cryogenic air separation system wherein all the feed air is pressurized to an intermediate pressure and cleaned of high boiling impurities at that intermediate pressure, and a portion further compressed to the high pressure and then cooled against another portion so as to prepare that other portion for the turboexpansion to the low pressure, preferably with the turboexpansion driving the further compression.

8 Claims, 2 Drawing Sheets

CRYOGENIC AIR SEPARATION SYSTEM FOR DUAL PRESSURE FEED

TECHNICAL FIELD

This invention relates generally to the cryogenic rectification of feed air and, more particularly, to the cryogenic rectification of feed air wherein the feed air is provided into the cryogenic air separation plant at two different pressure levels.

BACKGROUND ART

Numerous cryogenic air separation systems employ dual pressure air feeds. The usual way for supplying these feeds is to use a base load air compressor to raise the total air requirement to the pressure of the lower pressure air requirement, pass this air through a prepurifier for the removal of contaminants, and feed the portion needed at this pressure to the primary heat exchanger for processing. The remaining portion of the air is then boosted to the required higher pressure in a booster air compressor. This high pressure air is then fed to a second pass in the primary heat exchanger for further cryogenic processing. A substantial portion of the plant investment is involved with this part of the plant. Any improvement in this processing will yield a corresponding saving.

Accordingly, it is an object of this invention to provide an improved cryogenic air separation system using dual pressure air feeds which operates with better efficiency than conventional dual pressure air feed cryogenic air separation systems.

SUMMARY OF THE INVENTION

The above and other objects, which will become apparent to one skilled in the art upon a reading of this disclosure, are attained by the present invention, one aspect of which is:

A method for carrying out cryogenic air separation with a cryogenic air separation plant comprising a higher pressure column and a lower pressure column, said method comprising:

(A) compressing feed air containing high boiling impurities to a first pressure, and removing high boiling impurities from the feed air at the first pressure to produce clean feed air;

(B) further compressing a first portion of the clean feed air to a second pressure to produce high pressure feed air, and cooling the high pressure feed air by indirect heat exchange with a second portion of the clean feed air to produce cooled high pressure feed air and warmed feed air;

(C) passing the cooled high pressure feed air into the higher pressure column of the cryogenic air separation plant, turboexpanding the warmed feed air to produce turboexpanded feed air, and passing the turboexpanded feed air into the lower pressure column of the cryogenic air separation plant;

(D) separating the feed air by cryogenic rectification in the cryogenic air separation plant to produce at least one of product oxygen and product nitrogen; and (E) recovering at least one of said product oxygen and product nitrogen from the lower pressure column of the cryogenic air separation plant.

Another aspect of the invention is:

Apparatus for carrying out cryogenic air separation comprising:

(A) a cryogenic air separation plant comprising a higher pressure column and a lower pressure column;

(B) a first compressor, a prepurifier, means for passing feed air to the first compressor, and means for passing feed air from the first compressor to the prepurifier;

(C) a second compressor, a turboexpander, a turbine air heat exchanger, means for passing feed air from the prepurifier to the second compressor and from the second compressor to the turbine air heat exchanger, and means for passing feed air from the prepurifier to the turbine air heat exchanger and from the turbine air heat exchanger to the turboexpander;

(D) means for passing feed air from the turbine air heat exchanger to the higher pressure column of the cryogenic air separation plant, and means for passing feed air from the turboexpander to the lower pressure column of the cryogenic air separation plant; and (E) means for recovering product from the lower pressure column of the cryogenic air separation plant.

As used herein, the term "product nitrogen" means a fluid having a nitrogen concentration of at least 95 mole percent.

As used herein, the term "product oxygen" means a fluid having an oxygen concentration of at least 70 mole percent.

As used herein, the term "cryogenic air separation plant" means a plant, comprising at least two columns, which processes feed air and produces at least one of product nitrogen and product oxygen.

As used herein, the term "feed air" means a mixture comprising primarily oxygen and nitrogen, such as ambient air.

As used herein, the term "column" means a distillation or fractionation column or zone, i.e. a contacting column or zone, wherein liquid and vapor phases are countercurrently contacted to effect separation of a fluid mixture, as, for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column", is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the terms "upper portion" and "lower portion" mean those sections of a column respectively above and below the mid point of the column.

As used herein, the terms "turboexpansion" and "turboexpander" mean respectfully method and apparatus for the flow of high pressure gas through a turbine to reduce the pressure and the temperature of the gas thereby generating refrigeration.

As used herein, the term "high boiling impurities" means one or more of water vapor, carbon dioxide, and hydrocarbon(s).

As used herein, the term "compressor" means a device for increasing the pressure of a gas.

As used herein, the term "prepurifier" means a unit for removing high boiling impurities from feed air.

As used herein, the term "turbine air heat exchanger" means a heat exchange device for increasing the temperature of feed air prior to entering a turboexpander.

DETAILED DESCRIPTION

Many cryogenic air separation systems require two air feeds, one at a lower pressure and one at a higher pressure. This invention addresses this requirement with improved efficiency by employing a single compression system to supply the lower pressure air stream, a single prepurifier unit working at the discharge pressure of the baseload air compressor, and a turboexpander, preferably directly coupled to the booster compressor, to supply the refrigeration needs of the cryogenic processing. The heat of compression of the booster compressor is recovered to bring the turbine air feed to the proper temperature before turboexpansion. All of the work of expansion is efficiently recovered by means of a direct-coupled turboexpander and booster air compressor. This provides both lower and higher pressure air streams for cryogenic processing with an optimum arrangement minimizing equipment and power requirements thus saving capital and operating expenses.

Figure 1:
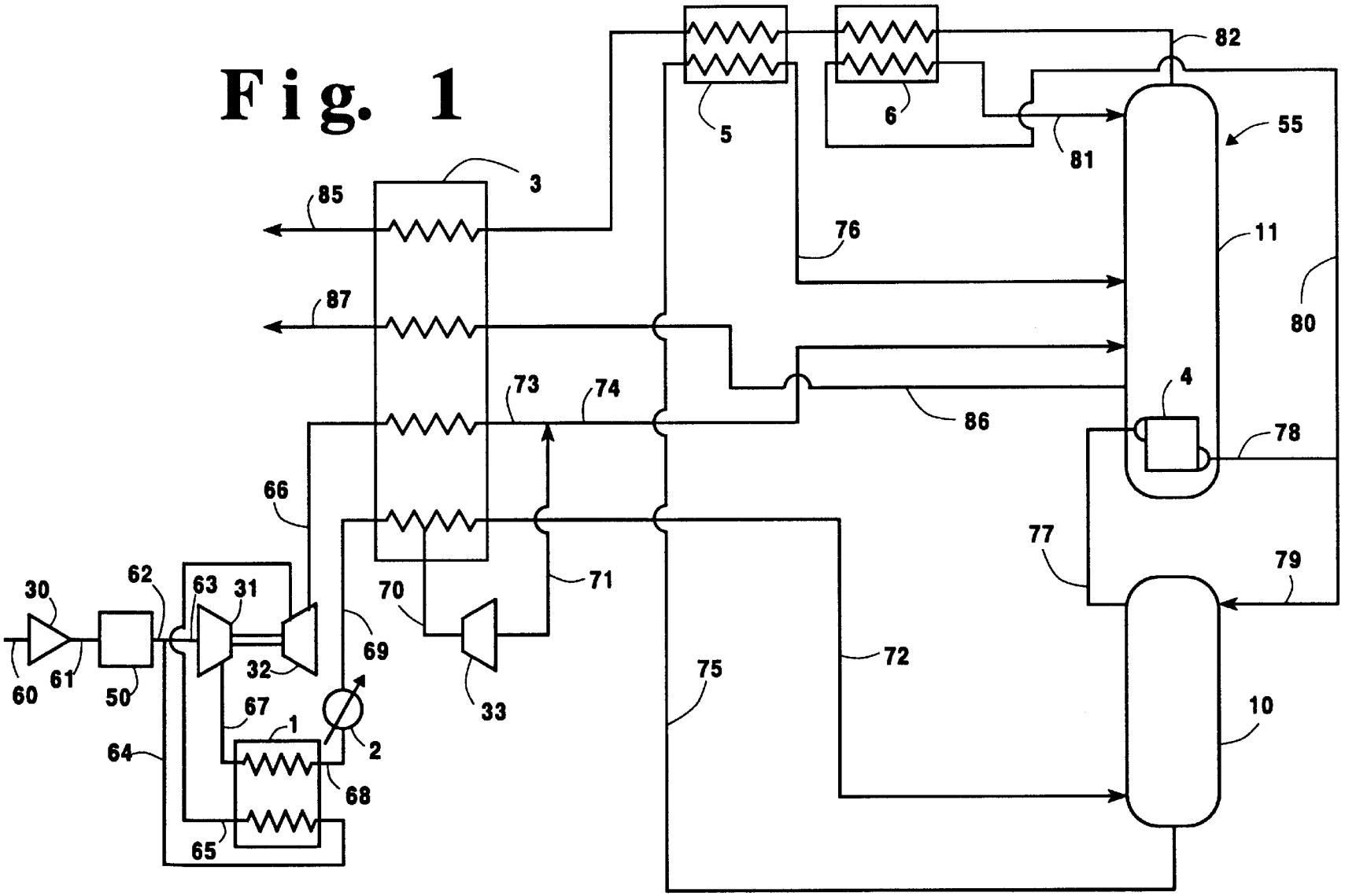
FIG. 1 is a schematic representation of one preferred embodiment of the cryogenic air separation system of this invention.

The invention will be described in detail with reference to the Drawings. Referring now to FIG. 1, feed air 60 containing high boiling impurities is compressed by passage through first or base load compressor 30 to a first pressure generally within the range of from 50 to 200 pounds per square inch absolute (psia). Resulting feed air 61 is passed through prepurifier 50 at the first pressure wherein high boiling impurities are removed from the feed air to produce clean feed air. The clean feed air 62 withdrawn from prepurifier 50 is divided into first portion 63, which comprises from about 40 to 90 percent of the feed air provided into the cryogenic air separation plant, and into second portion 64, which comprises from about 10 to 60 percent of the feed air provided into the cryogenic air separation plant.

First portion 63 of clean feed air 62 is further compressed to a second pressure, generally within the range of from 51 to 250 psia, by passage through second or booster compressor 31. Resulting high pressure feed air 67 is passed from first compressor 31 to and through turbine air heat exchanger 1 wherein it is cooled to produce cooled high pressure feed air 68. If desired, cooled high pressure feed air 68 may be further cooled by passage through cooler 2 to produce further cooled high pressure feed air 69 which is then cooled by indirect heat exchange with return streams by passage through primary heat exchanger 3 and then passed into higher pressure column 10.

Second portion 64 is passed to and through turbine air heat exchanger 1 wherein it is warmed by indirect heat exchange with the aforesaid cooling high pressure feed air. The resulting warmed feed air 65 is passed from turbine air heat exchanger 1 to turboexpander 32 wherein it is turboexpanded to produce turboexpanded feed air 66 which is then cooled by indirect heat exchange with return streams by passage through primary heat exchanger 3 and then passed into lower pressure column 11. Preferably, as illustrated in FIG. 1, turboexpander 32 is directly coupled to second compressor 31 thus serving to drive second compressor 31.

FIG. 1 illustrates a preferred embodiment of the invention wherein a portion of the cooled high pressure feed air is turboexpanded and passed into the lower pressure column. Referring back now to FIG. 1, a portion 70 of cooled high pressure feed air 69 is withdrawn after partial traverse of primary heat exchanger 3. The remaining portion 72 completes the traverse of primary heat exchanger 3 and passes into the lower portion of higher pressure column 10. Portion 70 is turboexpanded by passage through second turboexpander 33 to produce turboexpanded portion 71 which is combined with turboexpanded feed air 73 after it completes the traverse of primary heat exchanger 3. Turboexpanded portion 71 and turboexpanded feed air 73 form combined stream 74 which is passed into lower pressure column 11.

Cryogenic air separation plant 55 is a double column plant and comprises first or higher pressure column 10 and second or lower pressure column 11. Higher pressure column 10 is operating at a pressure generally within the range of from 50 to 250 psia. Within higher pressure column 10 the high pressure feed air fed into that column is separated by cryogenic rectification into nitrogen-enriched vapor and oxygen-enriched liquid. The oxygen-enriched liquid is withdrawn from the lower portion of higher pressure column 10 in stream 75, subcooled by passage through subcooler 5 and then passed as subcooled stream 76 into lower pressure column 11. Nitrogen-enriched vapor is withdrawn from the upper portion of higher pressure column 10 in stream 77 and passed into bottom reboiler 4 wherein it is condensed by indirect heat exchange with column 11 bottom liquid. Resulting nitrogen-enriched liquid 78 is divided into first part 79, which is returned to the upper portion of higher pressure column 10 as reflux, and into second part 80, which is subcooled by passage through subcooler 6 and then passed as subcooled stream 81 into the upper portion of lower pressure column 11 as reflux.

Lower pressure column 11 is operating at a pressure less than that of higher pressure column 10 and generally within the range of from 16 to 50 psia. Within lower pressure column 11 the various feeds are separated by cryogenic rectification into product nitrogen and product oxygen. Product nitrogen is withdrawn from the upper portion of lower pressure column 11 in vapor stream 82, warmed by passage through subcoolers 6 and 5 and primary heat exchanger 3, and recovered as product nitrogen in stream 85.

Product oxygen is withdrawn from the lower portion of lower pressure column 11 in vapor stream 86, warmed by passage through primary heat exchanger 3, and recovered as product oxygen in stream 87.

Figure 2:
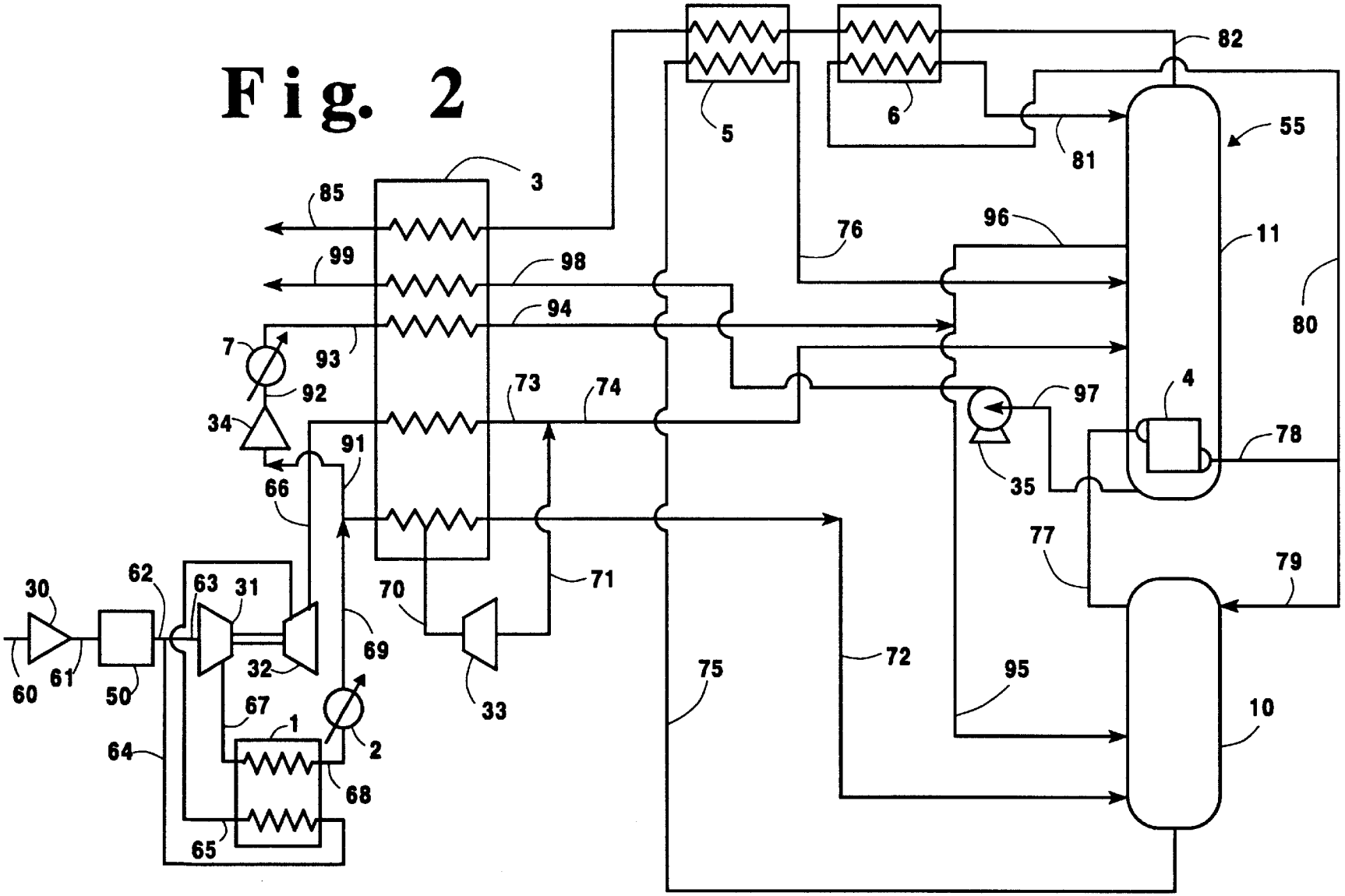
FIG. 2 is a schematic representation of another preferred embodiment of the cryogenic air separation system of this invention.

FIG. 2 illustrates another embodiment of the cryogenic air separation system of the invention wherein product oxygen is recovered at an elevated pressure. The numerals in FIG. 2 correspond to those of FIG. 1 for the common elements and these common elements will not be described again in detail.

Referring now to FIG. 2, a portion 91 of cooled high pressure feed air 69 is further compressed by passage through auxiliary compressor 34 to a pressure generally within the range of from 75 to 600 psia. Resulting pressurized stream 92 is cooled of the heat of compression by passage through cooler 7 and resulting cooled pressurized stream 93 is cooled and at least partially condensed by passage through primary heat exchanger 3. Resulting feed air stream 94 is divided into portions 95 and 96 which are passed into higher pressure column 10 and lower pressure column 11 respectively. Product oxygen is withdrawn from the lower portion of lower pressure column 11 in liquid stream 97 and pumped to an elevated pressure, generally within the range of from 20 to 250 psia, by passage through liquid pump 35. Resulting elevated pressure product oxygen stream 98 is vaporized by passage through primary heat exchanger 3 and recovered as elevated pressure product oxygen in stream 99.

Although the invention has been described in detail with reference to certain preferred embodiments, those skilled in the art will recognize that there are other embodiments of the invention within the spirit and the scope of the claims.

We claim:

1. A method for carrying out cryogenic air separation with a cryogenic air separation plant comprising a higher pressure column and a lower pressure column, said method comprising:

(A) compressing feed air containing high boiling impurities to a first pressure, and removing high boiling impurities from the feed air at the first pressure to produce clean feed air;

(B) further compressing a first portion of the clean feed air to a second pressure to produce high pressure feed air, and cooling the high pressure feed air by indirect heat exchange with a second portion of the clean feed air to produce cooled high pressure feed air and warmed feed air;

(C) passing the cooled high pressure feed air into the higher pressure column of the cryogenic air separation plant, turboexpanding the warmed feed air to produce turboexpanded feed air, and passing the turboexpanded feed air into the lower pressure column of the cryogenic air separation plant;

(D) separating the feed air by cryogenic rectification in the cryogenic air separation plant to produce at least one of product oxygen and product nitrogen; and (E) recovering at least one of said product oxygen and product nitrogen from the lower pressure column of the cryogenic air separation plant.

2. The method of claim 1 wherein the turboexpanding of the warmed feed air powers the further compressing of the first portion of the clean feed air.

3. The method of claim 1 further comprising turboexpanding a portion of the cooled high pressure feed air and passing the resulting turboexpanded feed air portion into the lower pressure column.

4. The method of claim 1 further comprising further compressing a portion of the cooled high pressure feed air to produce pressurized feed air, at least partially condensing the pressured feed air, and passing the resulting feed air into each of the higher pressure column and the lower pressure column.

5. Apparatus for carrying out cryogenic air separation comprising:

(A) a cryogenic air separation plant comprising a higher pressure column and a lower pressure column;

(B) a first compressor, a prepurifier, means for passing feed air to the first compressor, and means for passing feed air from the first compressor to the prepurifier;

(C) a second compressor, a turboexpander, a turbine air heat exchanger, means for passing feed air from the prepurifier to the second compressor and from the second compressor to the turbine air heat exchanger, and means for passing feed air from the prepurifier to the turbine air heat exchanger and from the turbine air heat exchanger to the turboexpander;

(D) means for passing feed air from the turbine air heat exchanger to the higher pressure column of the cryogenic air separation plant, and means for passing feed air from the turboexpander to the lower pressure column of the cryogenic air separation plant; and (E) means for recovering product from the lower pressure column of the cryogenic air separation plant.

6. The apparatus of claim 5 wherein the turboexpander is directly coupled to the second compressor.

7. The apparatus of claim 5 further comprising a second turboexpander, means for passing feed air from the turbine air heat exchanger to the second turboexpander, and means for passing feed air from the second turboexpander into the lower pressure column.

8. The apparatus of claim 5 further comprising an auxiliary compressor, means for passing feed air from the turbine air heat exchanger to the auxiliary compressor, and means for passing feed air from the auxiliary compressor into each of the higher pressure column and the lower pressure column.

* * * * *